United States Patent [19]

McGowan

[11] 4,027,687

[45] June 7, 1977

[54] PROTECTIVE AND/OR DECORATIVE COVER FOR WALKING AIDS

[76] Inventor: Malissa A. McGowan, 1502 E. 126th St., Compton, Calif. 90222

[22] Filed: Aug. 12, 1976

[21] Appl. No.: 713,671

[52] U.S. Cl. ..... 135/66; 2/DIG. 6; 24/DIG. 18; 135/67; 135/68; 150/52 R; 297/DIG. 6

[51] Int. Cl.[2] ..... B65D 65/08; A45B 3/00

[58] Field of Search ..... 150/52 R; 135/33 C, 135/66, 67, 68; 24/DIG. 18; 2/DIG. 6; 297/218, DIG. 6

[56] References Cited

UNITED STATES PATENTS

| | | | |
|---|---|---|---|
| 650,457 | 5/1900 | Ehlen | 150/52 R |
| 1,669,616 | 5/1928 | Johnson | 150/52 R |
| 3,143,154 | 8/1964 | Best | 297/DIG. 6 |
| 3,191,652 | 6/1965 | Benson et al. | 2/DIG. 6 X |
| 3,295,577 | 1/1967 | Danielson | 150/52 R |
| 3,383,738 | 5/1968 | Fox et al. | 2/DIG. 6 X |

FOREIGN PATENTS OR APPLICATIONS

| | | | |
|---|---|---|---|
| 1,287,504 | 2/1962 | France | 2/DIG. 6 |

OTHER PUBLICATIONS

P.N.R., No. 1103, dated Mar. 22, 1971.

*Primary Examiner*—Werner H. Schroeder
*Assistant Examiner*—Conrad L. Berman
*Attorney, Agent, or Firm*—Wills, Green & Mueth

[57] ABSTRACT

A protective and/or decorative cover for a walking aid which has a plurality of interconnected members, including at least one support member and one or more leg members, said cover being of flexible material and including one or more non-split primary tube portions with open ends to slidably enclose one or more of said leg members, and one or more elongate secondary tube portions which are split longitudinally for wrap-around enclosing engagement with other leg or support members. Each split tube portion has opposed edge surfaces which are provided with releasable, interengaging fastening means to hold each split tube portion about its related support or leg member in a neat and close engagement.

8 Claims, 16 Drawing Figures

PROTECTIVE AND/OR DECORATIVE COVER FOR WALKING AIDS

BACKGROUND OF THE INVENTION

This invention has to do with walking aids and is more particularly concerned with decorative and protective covers for walking aids.

It is not uncommon that people require mechanical devices to lend them aid and support while they are walking. The need for such devices or walking aids is brought about by any one or more of a multitude of causes or reasons. For example, the need for such devices might be brought about by physical injury to one's legs and/or back, by arthritis or other diseases which impair and/or limit joint movement, muscular strength, impairment of one's senses of balance and the like.

The most common and familiar walking aid device or devices are crutches and canes. In recent years, other devices, such as tripod canes and quadripod or four-leg walkers have been developed and are finding great favor and ever-increasing popularity among those who require the aid of such devices.

In fact, with the advent of tripod walking canes, that is, canes with three short downwardly divergent legs, which provide stable and sure ground engagement, the simple monopod type of cane is fast losing favor and its use is being substantially restricted to those who would carry a cane for cosmetic purposes, rather than for a genuine need for a walking aid.

In the past, crutches and canes have been commonly made of wood. In more recent years, the use of metal, such as aluminum tubing, channel sections and the like have become more common in the establishment of walking aids, particularly those more recently developed aid referred to in the preceding paragraphs.

As is well known, but for certain old fashioned monopod walking canes, walking aids are obviously utilitarian devices which are not simply unattractive, but are possessed with adverse aesthetic attributes.

As a general rule, due to the rather rough and abusive treatment to which such devices are unavoidably subjected, they are most commonly found in a rather battered and scarred condition, which adds to their unattractiveness.

In the case of the more modern walking aids, there are many circumstances and places where they cannot be safely used due to their electrical conductivity and/or due to their capacity to strike sparks when struck against other objects. As a result of the foregoing, many persons recovering from injuries or the like and requiring the use of walking aids, while capable of pursuing their work and livelihood, are prevented from doing so simply because of the potential hazard created by their walking aids.

In the case of the ordinary or common form of crutch, a plurality of exposed bolt-heads, wing-nuts and the like, provided to facilitate adjusting the vertical height of the crutches, and to facilitate adjusting the vertical spacing between the crutch pad and hand-grip, are ordinarily presented. Such exposed fasteners and the like, in addition to being unattractive, are subject to engaging and/or catching on other objects and things including the person using the aids and having great potential to cause unforeseeable injury and/or damage.

An object and feature of my invention is to provide a novel decorative and/or protective cover for walking aids.

It is another object and feature of my invention to provide a cover of the general character referred to which is such that it particularly lends itself to being established of attractive and/or decorative fabrics and is such that it neatly covers its related walking aid to effectively shroud and obscure the aid and to detract from its otherwise obvious mechanical and/or utilitarian appearance.

It is an object and feature of this invention to provide a cover or covers or the character referred to established of electrical and/or heat insulating and impact cushioning fabric, whereby the walking aid or aids with which the covers are related can be safely and effectively used in areas where the use of such aids, without covers as here provided, would be hazardous.

Another object and feature of my invention is to provide a fabric walking aid cover of the character referred to above which is such that it can be easily and quickly related to and removed from a related walking aid and is such that it adjusts or is readily and conveniently related to substantially all walking aids of the type or class for which it is intended and which are adjusted and set for persons of different size.

Still another object and feature of my invention is to provide a walking aid cover comprising a plurality of intersecting fabric tube portions engaged about related intersecting legs, bridges, rails and the like of related walking aids, and wherein certain of said tube portions are split to facilitate their engagement about related portions of related walking aids and which are provided with releasable fastening means which are coextensive with the split edges of said split tube portions.

It is another object of the present invention to provide a cover of the character referred to wherein the fabric is stretchable and such that it is engaged in snug biased relationship with the walking aid so as to be free of unattractive sags, wrinkles, slumps and the like.

Finally, it is an object of this invention to provide a structure of the character referred to wherein a releasable fastening means is that form of fastening means comprising fabric strips with interengageable hook and loop pile, sold under the trademark "VELCRO", which is releasably fastenable at selective locations throughout the area of the opposing strips and which is such that lateral and/or longitudinal shifting of the opposing strips to effect adjustment of the covers to related portions of the walking aids is permissible.

DETAILED DESCRIPTION OF THE INVENTION

This invention has to do with a decorative and/or protective cover for walking aids such as crutches, tripod canes and quadripod walkers, each of which aids comprises a frame-like load-supporting structure, characterized by a plurality of elongate, angularly related, intersecting legs, columns, bars, beams and the like, and by exposed and projecting parts or portions of screw-fastening means and the like.

The cover structure or structures here provided are flexible, decorative and/or protective fabric structures characterized by pluralities of elongate, angularly related, intersecting tube sections or portions cooperatively engageable about related parts and/or portions of related walking aids and are further characterized by the provision of first or primary tube portions with open ends and slidably engaged about selected legs or column like parts or portions of related walking aids having free, accessible ends; and by normally closed longitudinally split, secondary or branch tube portions engaged about related parts and/or portions of related walking aids and which are provided with releasable fastening means at and along their split edges to releasably retain them in closed engagement with and about their related walking aid parts.

Figures 1, 2, 3, 4, 5, 6, 7, 8, 9, 10:
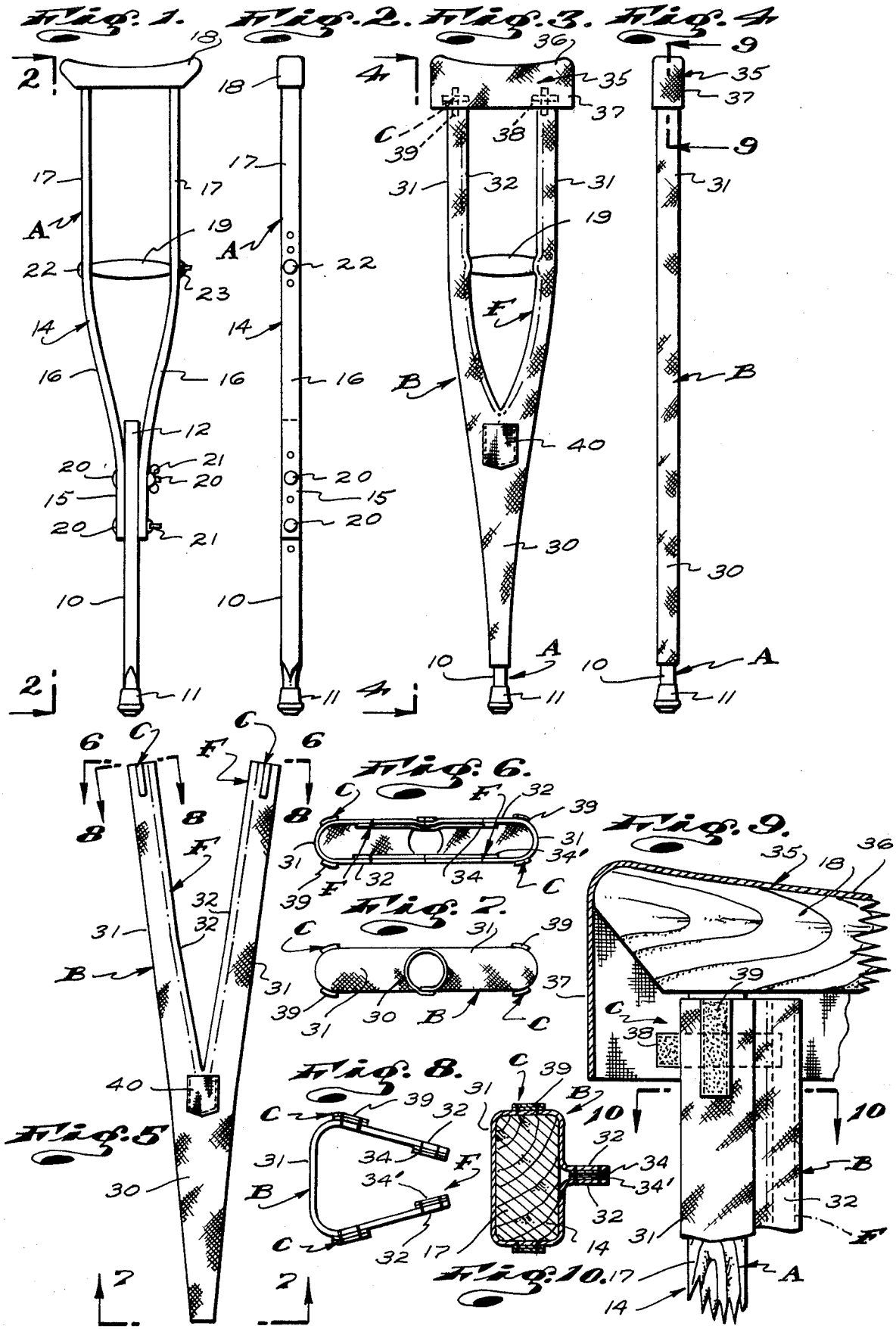
FIG. 1 is a side elevational view of a crutch of conventional construction.
FIG. 2 is a view taken as indicated by line 2—2 on FIG. 1.
FIG. 3 is a view similar to FIG. 1 showing a protective and decorative cover embodying the teachings of the present invention, used with said crutch.
FIG. 4 is a view taken as indicated by line 4—4 on FIG. 3.
FIG. 5 is an elevational view of the cover shown in FIGS. 3 and 4, separate from the crutch.
FIG. 6 is an enlarged view taken as indicated by line 6—6 on FIG. 5.
FIG. 7 is an enlarged view taken as indicated by line 7—7 on FIG. 6.
FIG. 8 is an enlarged detailed view taken as indicated by line 8—8 on FIG. 5.
FIG. 9 is an enlarged detailed sectional view taken substantially as indicated by line 9—9 on FIG. 4.
FIG. 10 is a view taken as indicated by line 10—10 on FIG. 9.

In FIGS. 1 and 2 of the drawings, I have illustrated a standard or conventional crutch-type walking aid A. The walking aid or crutch A includes an elongate, vertical, lower central primary leg 10 with a lower end covered or capped with a cup-type cane tip 11 and an upper end portion 12. The crutch next includes a pair of elongate vertical columns 14 with lower end portions 15 secured to opposite sides of the upper portion 12 of the leg 10, upwardly and outwardly inclined or curved intermediate portions 16 and substantially straight, vertical, laterally spaced upper portions 17. The crutch A next includes an elongate, substantially horizontal, arm-pit engaging beam or header 18 fixed to and extending between the upper ends of the upper portions 17 of the columns 14 and an elongate horizontal bar-like hand-grip 19 spaced below the header to extend between the lower end portions of the upper portions 17 of the columns 14.

The lower end portions 15 of the columns 14 are releasably secured to and/or with the upper end portion 12 of the leg 10 by vertically spaced pairs of through bolts 20. The bolts 20 carry wing-nuts 21 to facilitate tight releasable securing of the leg and columns in assembled relationship. The leg is provided with a plurality of vertically spaced pairs of bolt-receiving openings to facilitate vertical adjusting of the leg relative to the columns and resulting overall vertical adjustment of the crutch.

The hand-grip 19 is carried by a through bolt 22 extending through the columns and the grip. The bolt 22 carries a nut 23 to facilitate tightly releasably securing of the columns and grip together. The columns are provided with vertically spaced pairs of openings for the bolt 22, whereby the vertical positioning of the grip relative to the header can be effected, as desired or as circumstances require.

The leg, columns and header and grip of the crutch structure A are established of hardwood.

The structure of the crutch A, illustrated and described above, is a typical or common structure employed in the establishment of wooden crutches.

In practice, the details of construction of the crutch A are subject to considerable variations, but such variations have little or no effect on the instant invention.

Still further, crutches of the same general or basic structure or construction, illustrated and described above, are frequently established of metal channel and/or tube stock. Such a substitution of materials in no way affects my invention.

The decorative and/or protective cover B that I provide for the walking aid or crutch A is a flexible fabric structure including an elongate, vertical lower or primary tube portion 30 substantially coextensive with and engageable about the leg 10 and lower end portions 15 of the columns of the crutch A, a pair of elongate, substantially vertically branch or secondary tube portions 31, branching and extending upwardly from the upper end of the lower or primary tube portion 30. The secondary tube portions or branches 31 are substantially coextensive with and are engageable about and surround the intermediate and upper portions 16 and 17 of the columns 14. The secondary tube portions 31 are split longitudinally throughout their longitudinal extent, along their inner opposing sides and are provided with abutting or overlapping edge portions 32 with interengageable parts, elements or portions of releasable fastening means F, provided to secure them together.

The fastening means F is preferably that kind of fastening means sold under the trademark "VELCRO" and includes an elongate ribbon 34 of loop-pile fabric fixed to and extending longitudinally along one edge portion 32 and a mating ribbon 34′ of hook-pile fabric fixed to and extending longitudinally along the other edge portion 32 of each branch 31. The ribbons 34 and 35 are fixed to their related edge portions of the split tube portions as by stitching and so that the pile on the ribbons are in opposing, interengaged, holding relationship when the said tube portions are engaged about the columns with their edge portions juxtapositioned.

In practice, the VELCRO ribbons 34 and 34′ can be secured to their related edge portions 32 of the tube portions 31 so that the ribbons interengage when said edge portions are in overlapping engagement with each other or, as illustrated, when the edge portions of the tube portions are turned outwardly relative to their central axes and are urged into side-by-side relationship.

It is to be particularly noted that where the hand-grip 19 occurs and extends between the columns 14, the inner split sides of the secondary tube portions 31 cannot be closed and that the fastening means F, at or adjacent the grip 19, is necessarily interrupted by the grip.

Further, since the vertical positioning of the grip is subject to change, the location at which closing of the tube portions 31 and engagement of the fastening means F is prevented or interrupted by the grip is subject to being altered or changed.

In accordance with the above, the use of VELCRO fastening means is very important since VELCRO, unlike zipper-type fastening means and the like, is not dependent upon continuity of engagement for effective use and readily adopts itself to being engaged in an interruptive manner.

The cover B that I provide next includes a soft, flexible, fabric cap 35 having an upper portion 36 formed to overlie and cooperatively engage the top supporting or upper crutch surface of the header 18 and a skirt portion 37 depending from the upper portion 36 and about an upper terminal end portion of the columns 14 and secondary tube portions 31 of the cover, substantially as illustrated in FIGS. 3, 4 and 9 of the drawings.

The cover B next and finally includes releasable coupling means C to secure the cap 35 and tube portions 31 together, whereby the cap holds and supports the noted tube portions 31 up with respect to the columns 14 of the crutch. The means C preferably includes pairs of elongate, horizontal VELCRO ribbon strips or patches 38 fixed to opposite side surfaces of the skirt 37 of the cap 35 to occur adjacent opposite sides of the upper terminal end portions of the secondary tube portions 31 and elongate, vertical mating VELCRO ribbon strips or patches 39, fixed to the said opposite sides of the tube portions 31, whereby the related opposing strips or patches 38 and 39 engage each other in cross interengaged relationship and releasably secure the tube portions 31 to the cap 35.

It is to be noted that with the related VELCRO ribbon strips or patches 38 and 39 described above, a suitable and substantial amount or degree of horizontal and vertical adjustment is afforded for and between the cap 35 and tube portions 31, whereby dimensional variations which occur in the legs, columns and headers of crutches and/or which occur in the cover structure, can be easily and effectively compensated for.

It is to be noted that the cap 35 and coupling means C cooperate and serve the important function of holding and supporting the remainder of the cover structure in proper position and in engagement with the crutch structure. That is, the cap and means C are in essence an adjustable hanger or suspension means for the cover structure.

In the preferred carrying out of the invention, the lower primary tube portion 30, or at least the upper portion thereof, is flaired or tapered upwardly and outwardly (or downwardly and inwardly) and the lower portions of the upper secondary tube portions 31 are tapered downwardly and outwardly (or upwardly and inwardly), whereby the portions of the cover which occur about the enlarged and bulky portion of the crutch structure, where the legs and columns converge and are secured together by the screw fastening means described above, is enlarged to freely accommodate said bulky portion of the crutch structure and to cover that portion in a relatively smooth and attractive manner, as clearly illustrated in FIGS. 3 and 4 of the drawings.

In practice, the above noted enlarged portion of the cover A established by the flaired portions of the tube portions of said cover present flat plane surfaces which are particularly suited for the fixing and carrying of utility pockets 40, decorative applique and the like.

Further, in practice, the cap 35 is such that it will accommodate and effectively retain and obscure suitable padding, not shown, for the header 18.

In the preferred carrying out of my invention, when the cover A is provided for protective, rather than decorative purposes only, the fabric from which it is established is a two-way stretch fabric arranged with its directions of stretch disposed diagonally or at 45° to the central longitudinal axis of the leg, columns and header, whereby the fabric cover will yieldingly embrace the crutch structure substantially free of loose material, wrinkles and the like, will not stretch vertically and in such a manner as would cause the cover A to sag or slump and to render the cap 35 and means C incapable of holding up the remainder of the cover in proper suspension relative to the crutch structure.

In those instances where the cover is provided primarily for decorative purposes, the fabric need not be embodied with any particular stretch characteristics.

In those instances where a decorative fabric which is not capable of holding its shape is used, crinoline or other suitable reinforcing fabric or tape (not shown) is stitched in and/or along the interior of the cap and tube portions, whereby the cover is semi-self-supporting and is attractive when in use.

Figure 11:
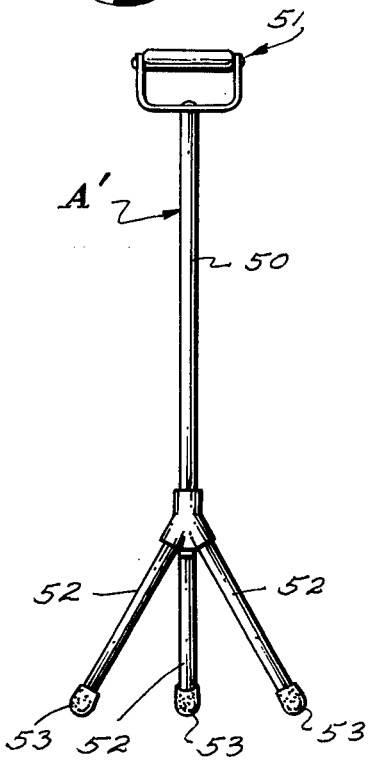
FIG. 11 is an elevational view of a tripod walking cane of conventional construction.

In FIG. 11 of the drawings, I have shown a typical tripod walking aid or cane A′. The cane A′ has a central, upper vertical column 50 with an open rectangular type hand grip 51 at its upper end and three circumferentially spaced downwardly and radially spaced outwardly inclined legs 52 depending from the lower end of a column and having rubber cane tips 53 at their lower ends.

Figure 12:
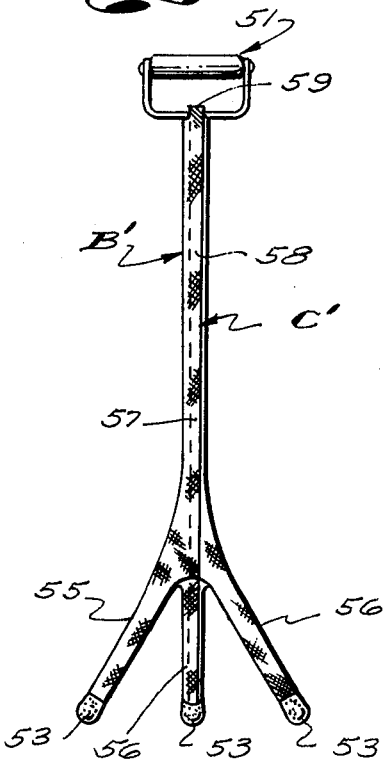
FIG. 12 is a view similar to FIG. 11 and showing a protective and decorative cover as provided by my invention, related to the cane.
Figure 13:
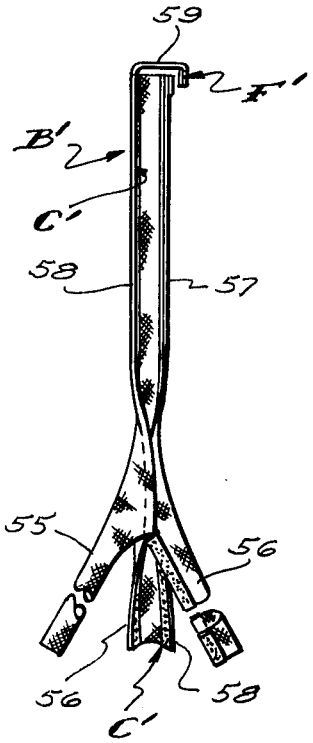
FIG. 13 is a view showing the cover illustrated in FIG. 12, separate from the cane.

In FIGS. 12 and 13 of the drawings, I have shown a cover B′ as provided by my invention, first related to and then separate from the cane A′.

The cover B′ is, in many ways, the same in construction as the cover B. The cover B′ distinguishes from the cover B in that it is inverted or upsidedown and has four, rather than three, tube portions. Specifically, the cover B′ has an elongate primary tube portion 55 which is not split and is engageable about and with one leg 52 of the cane A′, a pair of elongate secondary, longitudinally split leg-engaging tube portions 56 engageable about and with the other two legs 52 and an elongate, fourth, split central column-engaging tube portion 57. The related ends of the several tube portions, like the tube portions in the cover B, are flaired and converge and join with each other at a junction to accommodate the bulky portion of the cane A′ established by the junction of the column and legs.

The several tube portions have open outer free ends and have inner ends which communicate with each other.

The split tube portions of the cover B′ are provided with edge portions 58 and with VELCRO fastening means C′ which are essentially the same as the edge portions 32 and fastening means C in the first form of the invention.

The cover B′ is related to the cane A′ by first engaging one leg 52 of the cane into and through the primary tube portion 55 and thereafter engaging and closing the tube portions 56 and 57 about the other legs 52 and column 50. The cover B′ does not include a cap such as is provided in the first form of the invention to suspend and hold up the upper portion of the cover. Instead, it is provided with a strap 59 fixed to the upper end of the tube portion 57, at one side thereof, engageable through the open rectangular hand grip means 51, over the top of the column 50, and engageable with the other side of the tube portion.

Releasable fastening means F′ with interengageable or mating parts are provided on the strap and said other side of the tube portion 57 to fix the strap in place.

Figure 14:
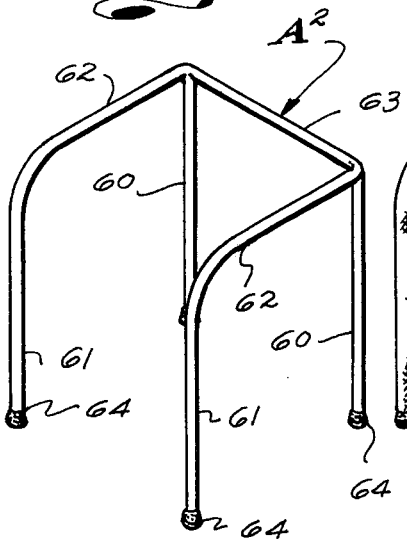
FIG. 14 is an isometric view of a quadripod walking aid of conventional construction.
Figure 15:
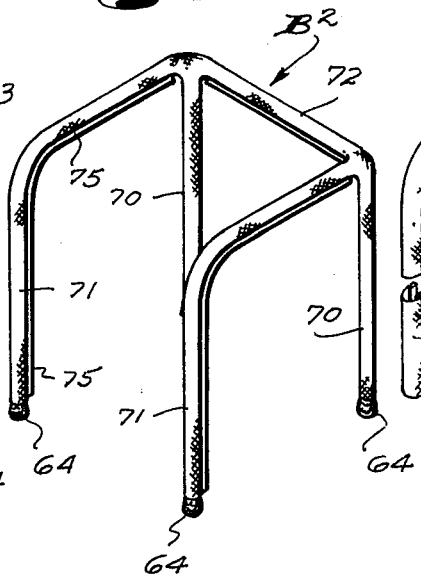
FIG. 15 is a view similar to FIG. 14 and showing a protective and decorative cover as provided by my invention related to the walking aid.
Figure 16:
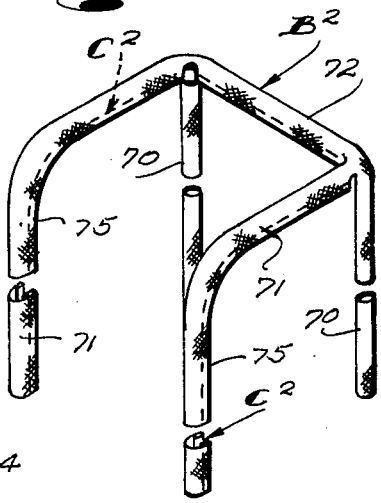
FIG. 16 is a view showing the cover illustrated in FIG. 15, separate from the walking aid.

In FIG. 14 of the drawings, I have illustrated a quadripod or four-leg walking aid $A^2$. The aid $A^2$ includes a pair of laterally spaced, vertical, inverted U-shaped tubular metal side frames with front and rear vertical leg portions 60 and 61 and horizontal, hand-engaging upper rail portions 62 extending between and integrally joined with the upper ends of the legs 60 and 61. The aid $A^2$ next includes an elongate horizontal, laterally extending hand-engaging front bar 63 fixed to and extending between the upper ends of the front legs 60. The lower ends of the four legs are, in accordance with common practice, capped with rubber cane tips 64.

The cover $B^2$ includes a pair of laterally spaced (unsplit) vertical, primary tube portions 70 slidably engaged about the front legs 60 of the aid $A^2$ and elongate, horizontal split secondary tube portions 71 and 72 angularly related to and having ends communicating with and joining the upper ends of the portions 71. The tube portions 71 are coextensive with and are engaged about related rear legs 61 and rails 62 and the tube portion 72 is coextensive with and is engaged about the bar 63 and has its opposite ends fixed to the upper and the forward ends of the related tube portions 70 and 71, substantially as shown.

The several split tube portions 71 and 72, like the split tube portions of the covers B and B′, are provided with edge portions 75 with VELCRO fastening means $C^2$ which are essentially the same as the edges 32 and fastening means C in the first and second forms of the invention.

In use, the portions 70 are slidably engaged on or with the legs 60 of the aid $A^2$ whereupon the portions 71 and 72 are engaged about the legs 61, rail 62 and bar 63, and the means $C^2$ related thereto are manually releasably secured to hold the portions 71 and 72 securely and neatly in place.

The cover $B^2$ can be greatly enhanced by fixing shock absorbing foam plastic sheeting having a high coefficient of friction to the inside surface of the tube portion 72 and the upper forward portions of the tube portions 72 so as to prevent slipping of the cover relative to the rails and the bar and to provide a more comfortable, cushioned grip for the user of the walking aid.

The portion 72 of the cover $B^2$ serves to suspend or hold up the other portions of the cover and on or about their related portions of the aid $A^2$.

In each form of the invention, the novel protective and/or decorative cover includes one or more nonsplit primary tube portions with open ends to slidably engage about a selected leg or legs of a related walking aid having a free and accessible end and includes two or more elongate open ended longitudinally split secondary tube portions angularly related to an end of the primary portion and having ends fixed to an end of the primary tube portion to communicate therewith. Each is releasably engageable about a related column, bar or rail of the walking aid with which the cover is related.

Further, each split tube portion of each cover structure herein provided is provided with longitudinal edge portions adapted to be engaged in lapped or side-by-side surface engagement with each other and which carry releasable fastening means which are substantially coextensive with said edge portions or split tube portions. Specifically, the split tube portions are provided with VELCRO fastening means throughout their longitudinal extent which means serve to releasably hold the split tube portions closed and in close, neat engagement about their related parts and/or portions of their related walking aids.

Having described only typical preferred forms and applications of my invention, I do not wish to be limited to the specific details herein set forth, but wish to reserve to myself any modifications and/or variations which may appear to those skilled in the art and which fall within the scope of the following claims:

I claim:

1. A protective and/or decorative cover for use with a walking aid which includes a load-supporting frame with a plurality of elongate angularly-related, intersecting leg, column and beam members, with one or more of said members having a free end, comprising:

a plurality of elongate, angularly-related intersecting tube portions in operative engagement, said tube portions being made from flexible material;

one or more of said tube portions being slidably engageable about said one or more members having a free end, substantially coextensive and in enclosing engagement therewith;

other tube portions being split longitudinally for substantial coextensive, enclosing engagement with others of said members, said split tube portions have opposed edge surfaces; and releasable, mating fastening means at said opposed edge surfaces extending substantially coextensive therewith for releasably securing said split tube portions about their related members in enclosing relationship.

2. A protective and/or decorative cover as set forth in claim 1, in which the segments of the tube portions adjacent the intersection of said portions are divergently tapered toward said intersection, whereby the interior of said cover is enlarged so as to accommodate the intersecting member of the frame adjacent thereto.

3. A protective and/or decorative cover as set forth in claim 1, in which the fastening means includes opposed, interengageable ribbons of loop and hook pile fabric, fixed to said opposed edge surfaces.

4. A protective and/or decorative cover as set forth in claim 1, in which the walking aid is a tripod cane with a central vertical column having an open hand grip at the upper end thereof and three outwardly inclined legs depending from the lower end of the column, said cover including:

a tube portion for slidable, enclosing engagement with one of said depending legs;

a pair of longitudinally-split leg-engaging tube portions for the other depending legs;

an elongate, longitudinally-split column-engaging tube portion; and releasable fastening means adjacent the upper end of the column-engaging tube portion for encircling a portion of the hand grip.

5. A protective and/or decorative cover as set forth in claim 1, in which the walking aid is four-legged with a pair of laterally-spaced front leg members, a horizontal beam member fixed to and extending between the upper ends of said front leg members, a pair of laterally-spaced vertically-extending rear leg members, and horizontal rail members extending between the upper ends of related front and rear leg members, said cover including:

tube portions for slidable, enclosing engagement with the two front leg members; and split tube portions for enclosing engagement with the rear leg members and the rail members.

6. A protective and/or decorative cover as set forth in claim 1, in which the walking aid is a crutch which includes a horizontal header member with an upper armpit-engaging surface extending between the upper ends of two spaced vertically extending members, said cover including:

a downwardly-opening cap for engagement with the header member, containing a top portion for overlying said armpit-engging surface and a depending skirt portion; and releasable means for coupling said cap with the upper ends of the tube portions which enclose the vertical members.

7. A protective and/or decorative cover as set forth in claim 6, in which the releasable coupling means comprises vertically-extending strips of fabric on the upper ends of the tube portions and horizontally-extending strips of fabric on the skirt portion of the cap, the strips on the tube portions being opposed to the strips on the skirt portion in a crossing relationship, and with said opposed strips having releasably-enterengageable loop and hook pile.

8. A protective and/or decorative cover as set forth in claim 6, in which the segments of the tube portions adjacent the intersections of said portions are divergently tapered toward said intersection, whereby the interior of said cover is enlarged so as to accommodate the intersecting member of the frame adjacent thereto.

* * * * *